US005733195A

United States Patent [19]

Wall

[11] Patent Number: 5,733,195

[45] Date of Patent: Mar. 31, 1998

[54] BATON

[75] Inventor: Robert C. Wall, Lloyd 500 Bldg., Ste 700, Portland, Oreg. 97232

[73] Assignee: Robert C. Wall, Portland, Oreg.

[21] Appl. No.: 725,967

[22] Filed: Oct. 4, 1996

[51] Int. Cl.[6] ..... F41B 15/02

[52] U.S. Cl. ..... 463/47.2; 482/109

[58] Field of Search ..... 482/50, 106, 107, 482/108, 109; 463/47.1, 47.2, 47.4, 47.5, 47.6, 47.7

[56] References Cited

U.S. PATENT DOCUMENTS

| | | | |
|---|---|---|---|
| 113,061 | 3/1871 | Kast . | |
| 365,904 | 7/1887 | Bradish | 463/47.2 |
| 385,293 | 6/1888 | Bean . | |
| 875,273 | 12/1907 | Kimble . | |
| 1,270,207 | 6/1918 | Preston . | |
| 1,572,289 | 2/1926 | Hogan . | |
| 2,625,764 | 1/1953 | O'Brien et al. . | |
| 3,307,754 | 3/1967 | Anketell . | |
| 3,944,226 | 3/1976 | Starrett | 463/47.2 |
| 4,020,985 | 5/1977 | Halterman . | |
| 4,098,503 | 7/1978 | Antone . | |
| 4,203,599 | 5/1980 | Starrett . | |
| 4,355,804 | 10/1982 | Bingham | 463/47.6 |
| 4,424,923 | 1/1984 | Bingham | 463/47.4 |
| 4,455,023 | 6/1984 | Saloom . | |
| 5,082,156 | 1/1992 | Braun . | |
| 5,180,164 | 1/1993 | Celaya . | |
| 5,192,074 | 3/1993 | Ashihara . | |
| 5,348,296 | 9/1994 | Frederiksen . | |

*Primary Examiner*—William M. Pierce

*Attorney, Agent, or Firm*—Klarquist Sparkman Campbell Leigh & Whinston, LLP

[57] ABSTRACT

A generally cylindrical baton having a center of gravity displaced from its longitudinal axis reducing the tendency of the baton to roll when laid on a generally horizontal supporting surface. The baton includes a flat end which permits the baton to rest vertically on a generally horizontal supporting surface and a handle operatively connected to a substantially rigid band secured between the ends of the baton which slides along the length of the baton permitting the baton to be easily concealed while being carried.

11 Claims, 3 Drawing Sheets

BATON

TECHNICAL FIELD

The present invention is directed to a baton which may be used for exercise, personal defense, stunning or killing fish, and similar activities. Particularly, the present invention relates to an improved baton assembly precluding the baton from rolling when placed on a generally horizontal surface and an improved handle assembly for concealing and carrying the baton.

BACKGROUND INFORMATION

People regularly place their personal safety at risk. For example, walking or jogging in isolated areas can place an individual at risk of being attacked by an assailant or bitten by an animal, including a dog.

Even when a person is relatively secure within their home, there remains some risk of personal attack from a prowler or burglar. Perhaps the most troublesome of these types of attacks involve a person being awakened during the night by such a prowler. Because of the darkness, it may be difficult for this person to see or easily locate an object to help defend themselves or others from attack.

Similarly, law enforcement officers frequently must subdue suspects through use of force. An officer's "night stick" has proven to be particularly effective for accomplishing this task. See U.S. Pat. No. 4,203,599 to Starrett; U.S. Pat. No. 5,180,164 to Celaya; and U.S. Pat. No. 5,192,074 to Ashihara.

In addition, the need for a simple and reliable device for use in stunning or killing fish has been documented. See U.S. Pat. No. 5,348,296 to Frederiksen. However, the limited area and marine environment of a boat often pose unique requirements and limitations on the design, use and storage of such devices.

The idea of someone using a baton to protect themselves and subdue animals has been known for centuries. More recently, however, several improvements to the baton itself and devices for holding it have been disclosed. For example, see U.S. Pat. No. 4,020,985 to Halterman; U.S. Pat. No. 4,203,599 to Starrett; U.S. Pat. No. 4,455,023 to Saloom; U.S. Pat. No. 5,180,164 to Celaya; and U.S. Pat. No. 5,192,074 to Ashihara.

In general, these known devices attempt to improve on a baton in the following ways: 1) disclosing improved materials offering greater strength or flexibility of the baton, 2) providing improved means for concentrating weight at the striking end of the baton; and 3) a handle for greater control over the baton during use, easier access to the baton during storage, increased protection of the user's hand, or permitting the handle to act like a set of brass knuckles.

In spite of these attempted improvements, there remains a need for a light weight, simple, easy-to-use portable baton that remains stationary and will not roll around when placed longitudinally on a generally horizontal surface. For example, it is desirable that a baton placed on a night stand or floor next to a bed for personal protection remain where it was placed throughout the night in spite of minor disturbances such as being bumped while setting an alarm clock. Similarly, it is desirable for a baton used in fishing to remain stationary when not in use when the boat rocks on the water.

In addition, a baton resting longitudinally on a floor presents a significant risk of someone inadvertently tripping over it or slipping on it. None of the known batons disclose a means for permitting the baton to rest vertically on one end for quick access in the dark and easy and safe storage.

Also, under some circumstances it is desirable to conceal the baton while still having it readily available for use when needed. For example, a walker or jogger may not wish conspicuously to carry a baton in front of their neighbors, but may still desire the personal security afforded in carrying a baton on their walk or jog. However, none of the known batons or handles provide their users with a readily available means for concealing the baton in a manner that would permit the user to walk or jog effectively while still permitting them instant use of the baton.

SUMMARY OF THE INVENTION

The primary object of the present invention is to provide an improved baton which may be used for exercising, personal defense, stunning or killing fish, and similar activities.

Another object of the invention is to provide a generally cylindrical baton that is inhibited from rolling when placed on a generally horizontal supporting surface.

Yet another object of the invention is to provide a baton having a handle permitting easy concealment and use of the baton.

A further object of the invention is to provide a baton capable of resting vertically on one end.

Further objects of the invention include providing a baton that is durable, light-weight, easy-to-use, portable, and easily assembled.

The illustrated embodiment of the invention comprises a cylindrical longitudinal shaft having a center of gravity displaced from the cross-sectional center of the shaft reducing the tendency of the baton to roll when laid in a substantially horizontal position. In cases where it is desirable to conceal the baton while carrying it, a substantially rigid band sized and positioned to slide along the shaft may be secured between the ends of the shaft with a handle encircling the user's wrist operatively connected to the band. If desired, the shaft may have at least one flat end permitting the shaft to rest vertically on that end.

DESCRIPTION OF A PREFERRED EMBODIMENT

Figure 1:
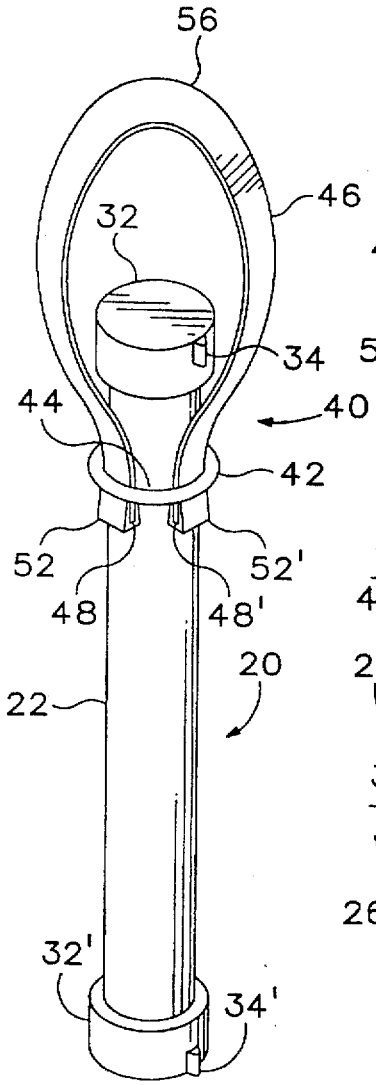
FIG. 1 is a perspective view of the baton assembly in accordance with a preferred embodiment of the present invention having a slidable handle assembly.
Figure 2:
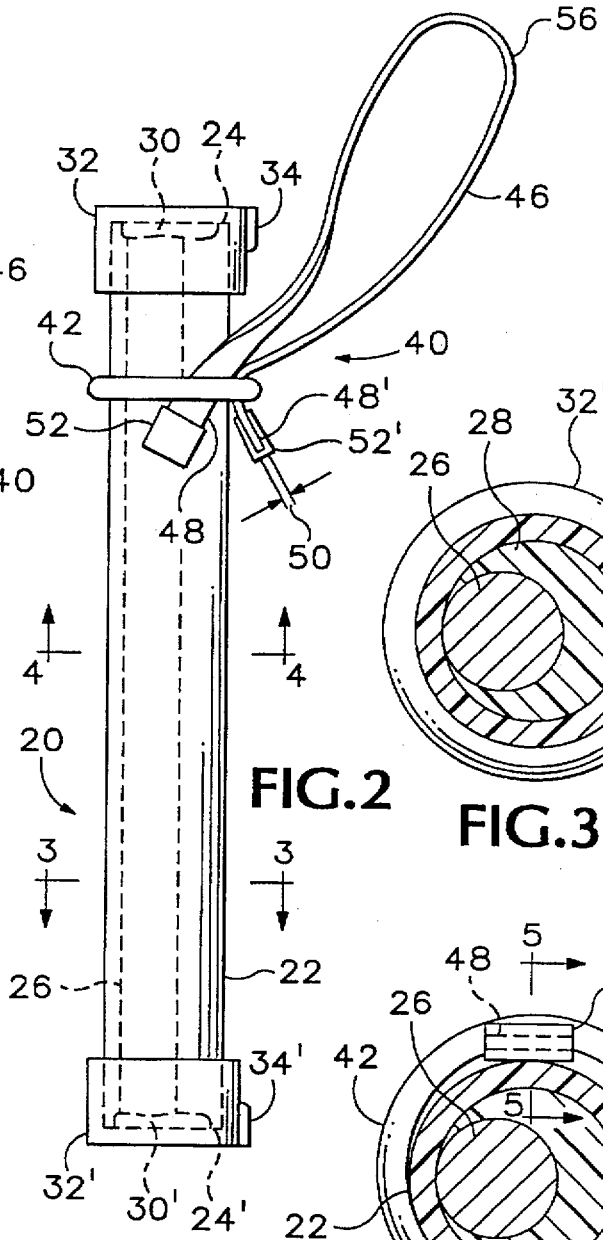
FIG. 2 is an enlarged front plan view of the baton assembly of FIG. 1.

A baton 20 in accordance with a preferred embodiment of the invention is shown in FIGS. 1 & 2.

The baton 20 includes an elongated generally cylindrical tubular shaft 22 having a longitudinal axis. The shaft 22 is constructed of a generally rigid and durable material, preferably plastic, such as, for example, polyvinylchloride ("PVC") One or both opposite shaft ends 24 & 24' may be cut flat generally perpendicular to the longitudinal length of the shaft 22. This will permit the shaft 22 to rest vertically on a generally horizontal supporting surface.

The length of the shaft 22 defines the overall length of the baton 20, and it can be sized as desired for the particular purpose to which the baton 20 will be used. For example, if the baton 20 is to be used for personal defense, it may be desirable for the shaft 22 to be approximately 12 inches long. At this length, it may be readily carried in a purse, stored in a glove-box, or concealed when being carried, while still providing a desirable degree of protection as a weapon. This length also appears well suited for use as a baton 20 for stunning or killing fish while still permitting the baton 20 to fit easily within a tackle box. If it is to be used as a hand or arm exercising device, a longer length may be desired.

The circumference of the shaft 22 should be sized and shaped to permit an individual to grasp it easily. The cylindrical shaft 22 is particularly well suited for this purpose, although another shaped shaft may also be used. Preferably, traditional PVC tubing is used for the shaft 22 having an outer diameter of approximately 1 inch and an inner diameter of approximately ¾ of an inch. This tubing may be readily cut to the desired length using a saw.

The surface of the shaft 22 may also be treated to improve its ability to be gripped by an individual. For example, if desired, notches could be cut, the surface could be roughened, or other known materials could be applied along the length of the shaft 22 to improve the ability of the shaft 22 to be gripped during use.

In order to reduce the likelihood of the shaft 22 rolling when placed on a generally horizontal supporting surface, the center of gravity about the longitudinal axis of the baton 20 preferably should be off-center from the cross-sectional center of the shaft 22. This may be accomplished by a variety of methods, including placing an element having greater density than that of the shaft 22 in an off-centered arrangement within the shaft 22. Similarly, a shaft having a varying density distributed to provide the shaft with a center of gravity displaced from the shaft's longitudinal axis could be utilized.

Figure 3:
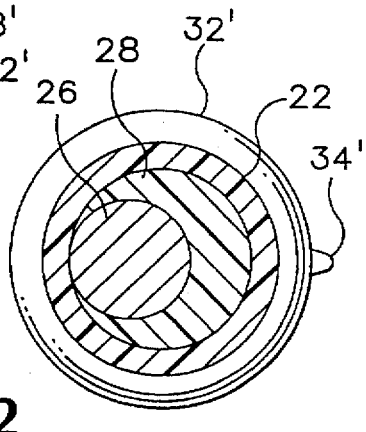
FIG. 3 is an enlarged cross-sectional view taken along line 3—3 of FIG. 2.
Figure 4:
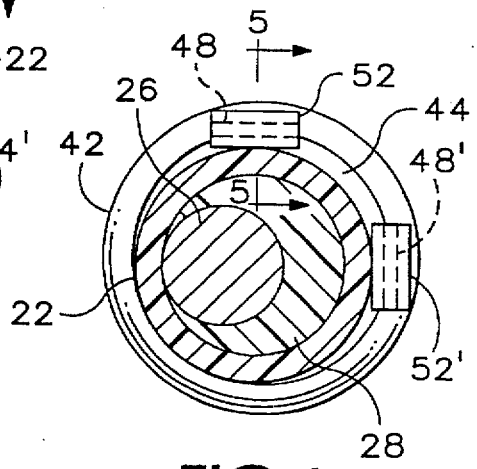
FIG. 4 is an enlarged cross-sectional view taken along line 4—4 of FIG. 2.
Figure 5:
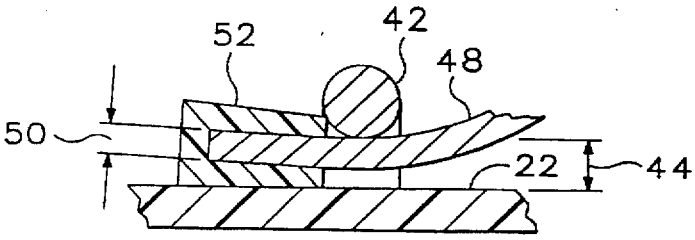
FIG. 5 is in enlarged cross-sectional view of the baton and handle assembly taken along line 5—5 of FIG. 4.

Referring how to FIGS. 2 & 3, the off-centered density arrangement is preferably obtained by placing a metal rod 26 within the shaft 22 and securing it in a displaced position off-center from the longitudinal axis of the shaft 22. Preferably, the rod 26 is metal with a length slightly less than the length of the shaft 22 and an outer diameter smaller than the inner diameter of the shaft 22. A length of re-bar rod, typically used to reinforce concrete structures and having an approximate outer diameter of ½ an inch, is particularly well adapted for this application.

The rod 26 may be positioned within the shaft 22 in an off-center position by any suitable means. Preferably, the rod 26 is secured within the shaft 22 by applying a suitable adhesive between the rod 26 and shaft 22. Particular success has been had by using a silicone sealant as the adhesive. Such sealant has been primarily used to seal exterior surfaces of buildings. One known manufacturer of this sealant is the General Electric Corporation, although numerous other manufactures are currently available.

After this adhesive has set, it is preferable to pack the ends within the shaft 22 not occupied by the rod 26 with a foam substance 28. This foam substance 28 should be sufficiently rigid and packed within the shaft 22 to preclude the rod 26 from moving freely within the shaft 22. However, the foam substance 28 may still provide a degree of vibration isolation and resiliency when the baton 20 strikes an object. Strips of traditional polyurethane foam insulation used to insulate pipes from cold temperatures have proven particularly well adapted for this purpose, although other known types of foam substances, including polystyrene, could also be used.

After the rod 26 and foam substance 28 are positioned within the shaft 22, it is desirable to liberally apply two amounts of additional adhesive 30 & 30', one at each shaft end 24 & 24', respectively, to generally fix the rod 26 and foam substance 28 in position and prevent the rod 26 and foam substance 28 from sliding out.

After the additional adhesive 30 & 30' has had an opportunity to set, it is preferable to enclose the shaft ends 24 & 24' with end caps 32 & 32'. The end caps 32 & 32' are sized and shaped to fit snugly over each shaft end 24 & 24', and preferably have a flat end perpendicular to the longitudinal length of the shaft 22 permitting the baton 20 to rest vertically on either end cap 32 or 32'. The end caps 32 & 32' may be rigidly secured to the shaft ends 24 & 24' with PVC cement.

Preferably, projections 34 & 34' are provided one on each end cap 32 & 32', respectively. As best shown in FIG. 3, each projection 34 & 34', here projection 34', is aligned diametrically opposite the center of gravity of the baton 26. The projections 34 & 34' alert users of the longitudinal resting position of the baton 20.

If PVC pipe is used to form the shaft 22, commercial PVC tube end caps 32 & 32' may be readily used for this purpose. PVC mounting cement should be applied to secure the end caps 32 & 32' to the shaft 22, and a small amount of adhesive should be placed in the center of the end cap 32 & 32' to fill any void between the previously applied adhesive 30 & 30' and the end cap 32 & 32' when each end cap 32 a 32' is secured in position. Prior to mounting the end caps 32 & 32', however, it is desirable to puncture the adhesive 30 & 30' at each shaft end 24 & 24'. This will equalize the pressure within the shaft 22, and prevent the adhesive 30 & 30' from interfering with the mounting of the end caps 32 & 32'.

In accordance with the preferred embodiment, a handle assembly 40 is secured to the shaft 22. It should be obvious that the handle assembly 40 may be installed whether or not the shaft 22 has a displaced center of gravity.

The handle assembly 40 includes a substantially rigid circular band 42, preferably of metal, sized and shaped to encircle the cross-section of the shaft 22. The band 42 has an inner diameter greater than the outer diameter of the shaft 22 providing a gap 44 therebetween, but the inner diameter of the band 42 is less than the outer diameter of the end caps 32 & 32'. Accordingly, with the end caps 32 & 32' rigidly secured to the shaft 22, the band may move longitudinally along the shaft 22 but is retained on the shaft 22 by the end caps 32 & 32'.

Preferably, where the shaft 22 is a length of PVC tube having an outer diameter of approximately 1 inch and a uniformly shaped and sized cross-section along its length, the band 42 is a circular ring having an inner diameter of approximately 1⅛ inches, and the end caps 32 & 32' have an outer diameter of approximately 1¼ inches.

Figure 6:
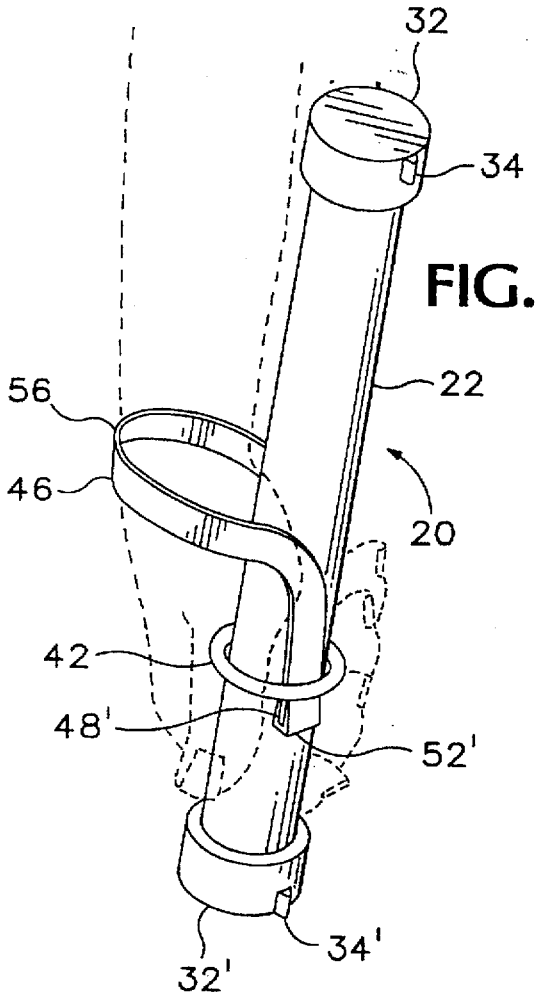
FIG. 6 is a perspective view of the baton assembly of FIG. 1 with a fragmentary outline of a hand and forearm to show possible orientation and concealment of the baton as it is carried.

The handle assembly 40 includes a length of strap-like flexible material 46, preferably a woven nylon strap with cauterized ends to minimize fraying, having two opposite end portions 48 & 48' operatively connected to the band 42 with the intermediate portion of the flexible material defining a loop 56 to encircle a wrist as depicted in FIG. 6. The flexible material 46 should have a thickness 50 such that the loop 56 may be inserted in the gap 44 between the shaft 22 and band 42 without binding the band from movement longitudinally along the shaft.

Referring now to FIGS. 1, 2 & 4–6, each end portion 48 & 48' is enlarged and generally rigid as compared to the nominal thickness 50 of the flexible material 46 to provide a generally inelastic thickness greater than the gap 44 between the shaft 22 and the band 42. With the end portions 48 & 48' enlarged as described, the loop 56 is inserted in the gap 44 between the shaft 22 and band 42 and pulled through so that the end portions 48 & 48' rest near the band 42. Because the end portions 48 & 48' are thicker than the gap 44, they are precluded from passing between the band 42 and shaft 22 enabling the baton 20 to be carried by or swing from the loop 56. However, the band 42 remains free to slide along the shaft 22.

This handle assembly 40 permits the easy adjustment and replacement of the flexible material 46 without the need for removing or disassembling any components on the baton 20.

Figure 7:
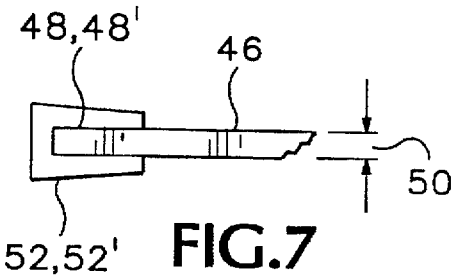
FIG. 7 is an enlarged fragmentary side elevation of the end portions of the handle of the embodiment of FIG. 1.
Figure 8:
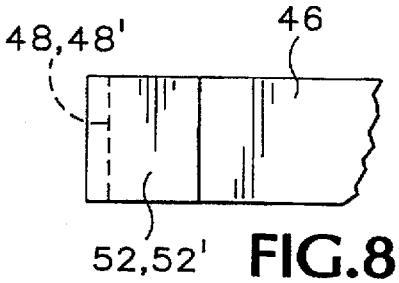
FIG. 8 is a fragmentary plan view of the embodiment of FIG. 7.

The handle ends 48 & 48' may be enlarged as described by a variety of methods. Preferably, as best shown in FIGS. 7 & 8, a generally rigid clip 52 & 52', constructed of plastic, is rigidly secured to each end portion 48 & 48'. A strip of plastic molding, designed as a spline for electronic wiring has proven particularly well adapted for this application, and may be secured in place with any suitable cement such as a fast curing cement. One such cement is sold by the Super Glue Corporation under the trademark "SUPER GLUE."

Figure 9:
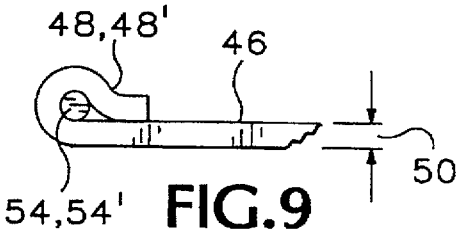
FIG. 9 is a fragmentary side elevation of an alternative embodiment of the end portions of the handle of FIG. 1.
Figure 10:
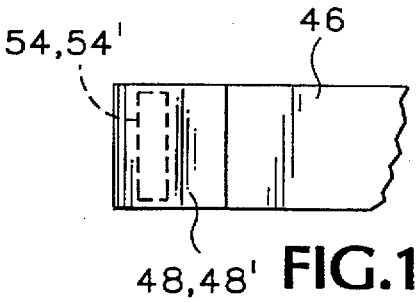
FIG. 10 is a fragmentary plan view of the embodiment of FIG. 9.

Alternatively, as best shown in FIGS. 9 & 10, each end portion 48 & 48' can be formed by folding a portion of each end of the flexible material over a small length of generally rigid material 54 & 54' having the desired thickness, for example a strip of solder. The end of the flexible material is then secured to the flexible material, as by gluing with a fast curing cement, enclosing the rigid material 54 & 54' in the fold.

Figure 11:
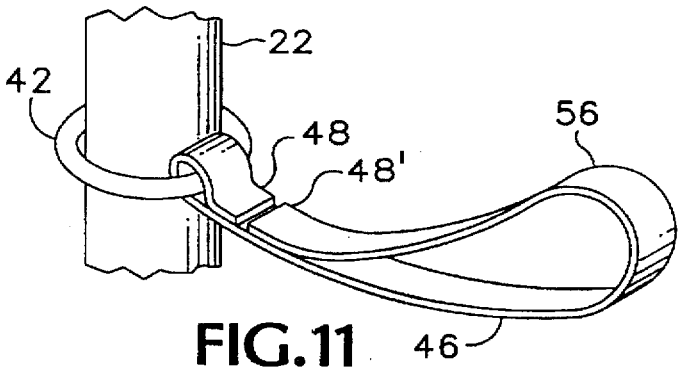
FIG. 11 is a fragmentary side elevation of a baton assembly showing an alternative handle embodiment.

In an alternative embodiment, best shown in FIG. 11, a handle is formed when one end portion, here end portion 48, passes between the band 42 and shaft 22 and is rigidly secured around the band 42. The other end portion, here end portion 48', is secured, which may include being detachably secured, to the flexible material 46 near the band 42 forming a loop 56.

Figure 12:
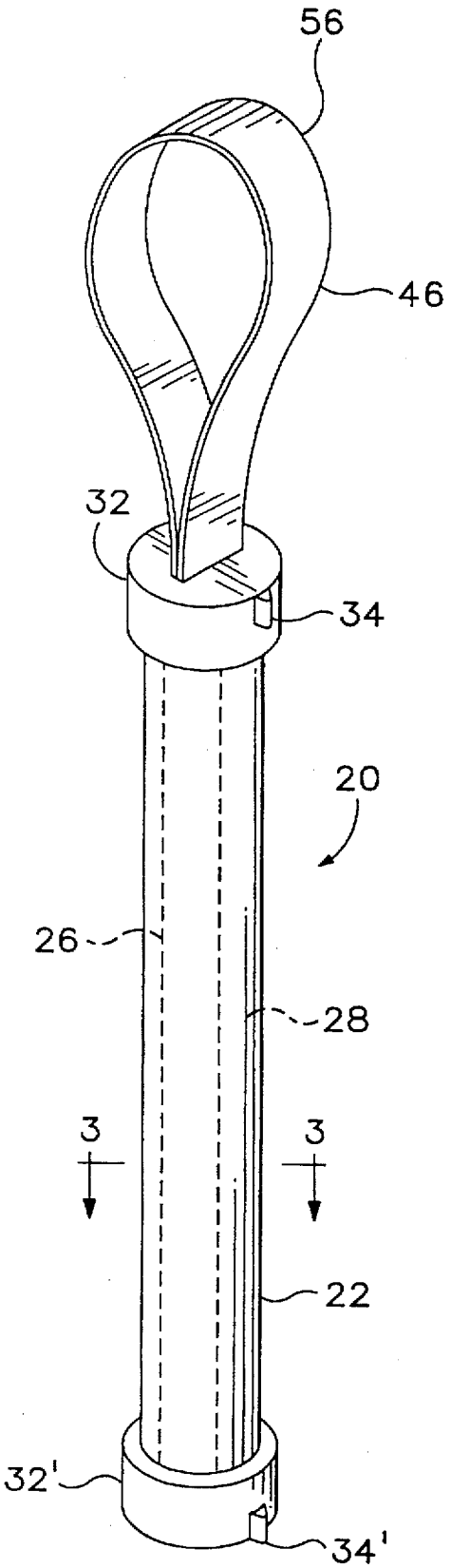
FIG. 12 is a front perspective view of a baton assembly in accordance with the present invention having a fixed handle assembly.
Figure 13:
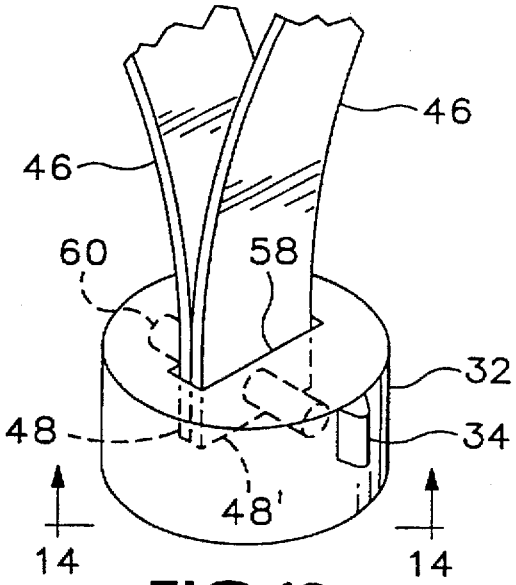
FIG. 13 is an enlarged, fragmentary view of the cap portion and handle of the embodiment of FIG. 12.
Figure 14:
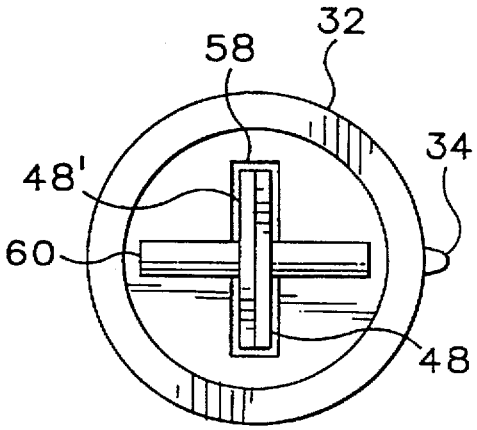
FIG. 14 is a bottom plan view of the cap looking in the direction of the arrows 14—14 in FIG. 13.

Referring now to FIGS. 12–14, if a slidable handle assembly on the baton 20 is not desired, a handle may be rigidly secured to either shaft end 24 or 24' through a variety of methods. For example, one of the end caps, here end cap 32, may be provided with a slit 58 sized to receive the end portions 48 & 48'. Before the end cap 32 is secured to the shaft 22, and as best shown in FIG. 13, the flexible material 46 is folded over and end portions 48 & 48' passed through the slit 58 into the interior of the end cap 32. A rigid pin 60, preferably constructed of metal and generally perpendicular to the slit 58 is then passed through the end portions 48 & 48'.

Preferably, one or both of the end portions 48 & 48' are folded on themselves in the area through which the pin 60 passes through, thereby permitting the end portions 48 & 48' to serve as a wedge further securing the flexible material 46 in the slit 58 and increasing the overall strength of the connection between the pin 60 and the end portions 48 & 48'.

Adhesive secures the pin 60 and flexible material 46 in place to preclude withdrawal of the handle from the end cap 32, which is secured to the shaft 22.

The general use of a baton is known. A user grabs the shaft 22 at one shaft end 24 or 24' and strikes desired objects, animals, or assailants as needed. If installed, the handle may be secured around the user's wrist permitting improved holding and storage of the baton 20.

In addition, the baton 20 may also be used as an exercise device. For example, it may be used to exercise an individual's wrist. The user grasps the baton 20 near its longitudinal center and moves his or her hand in a circular or semi-circular motion at the wrist improving the strength and range of motion of the wrist. Similarly, the baton 20 may be held while an individual walks, jogs, or engages in other aerobic activities increasing the upper body strength and cardio-vascular benefit of the activity.

For batons configured with a center of gravity displaced from the longitudinal axis of the shaft 22, the baton 20 will not roll when laid longitudinally on a generally horizontal surface. Referring now to FIG. 3, specifically, when the baton 20 is laid on its side, gravity will force the rod 26 or other uneven weight within the shaft 22, to seek an equilibrium resting position closest to the horizontal surface as possible. Slight or even modest disturbances of the baton 20, will not appreciably disturb the resting position of the baton 20 or cause it to roll.

Alternatively, as best shown in FIG. 2, where the baton 20 is equipped with at least one flat end as described, the baton 20 may rest vertically on a horizontal surface for quick and easy access.

As best shown in FIG. 6, for a baton 20 equipped with the improved handle assembly 40 as described, the baton 20 may be readily concealed while carrying it. The user places the loop 56 around their wrist with the band 42 positioned toward one end cap 32 or 32', here end cap 32'. The user then grasps the band 42 and the shaft 22 at or near one end cap, here end cap 32', with the remainder of the shaft 22 concealed by the user's arm as shown.

Should the user need to quickly use the baton 20 as a weapon, he or she simply loosens their grip on the shaft 22 while still retaining hold of the band 42. As a result, the band 42 will slide down the shaft 22 ultimately coming to rest on one of the end caps 32 or 32', here end cap 32. The flexible material 46 will continue to secure the baton 20 to the user while properly positioning the user's hand to grasp the shaft 22 at one shaft end 24 or 24'. The user is now free to grasp the shaft 22 and use the baton 20.

Of course, it should be understood that various changes and modifications to the preferred embodiments described herein will be apparent to those skilled in the art. For example, it is apparent to one skilled in the art that the shape of the generally cylindrical shaft 22 includes the overall shape of a traditional club, baseball bat, police officer's night stick, and similarly shaped objects. Similarly, the band 42 may be secured between the shaft ends 24 & 24' by a variety of other known methods including machining the shaft to have the specified larger outer diameter at or near one or both of its ends.

Accordingly, I claim all such changes and modifications that come within the scope and purview of the appended claims.

What is claimed is:

1. A baton comprising:

a generally cylindrical shaft having a longitudinal axis, two opposite ends, a uniformly shaped and sized cross-section along said longitudinal axis, and weight means within said shaft providing a center of gravity displaced from said axis thereby reducing the tendency of said shaft to roll when laid upon a substantially horizontal supporting surface;

a substantially rigid band encircling said shaft, and capable of sliding along the length of said shaft;

a handle operatively connected to said band; and retaining means on said shaft adjacent each of said ends for retaining said band on said shaft.

2. The baton according to claim 1, wherein said band is circular and has an inner diameter greater than the outer diameter of said cross-section forming a gap of predetermined amount between said band and said shaft; and said handle comprises a length of flexible material having two opposite end portions, said material doubled upon itself defining a loop sufficiently large to encircle a wrist, said end portions being operatively connected to said band to prevent said loop from being withdrawn from said band.

3. The baton of claim 2 wherein said shaft is an elongate cylindrical tube.

4. A baton comprising:

an elongate cylindrical tube having a longitudinal axis, two opposite ends, an uniformly shaped and sized cross-section along said longitudinal axis, and an element of greater density than said tube mounted in said tube in an off-center position relative to said longitudinal axis thereby reducing the tendency of said tube to roll when laid upon a substantially horizontal supporting surface;

a substantially rigid circular band encircling said tube, and having an inner diameter greater than the outer diameter of said cross-section forming a gap of predetermined amount between said band and said tube, said band capable of sliding along the length of said tube;

a handle including a length of flexible material having two opposite end portions, said material doubled upon itself defining a loop sufficiently large to encircle a wrist, said end portions being operatively connected to said band to prevent said loop from being withdrawn from said band; and retaining means on said tube adjacent each of said ends for retaining said band on said tube.

5. The baton of claim 4 further comprising a foam substance received within said tube and securing and retaining said element in said off-center position.

6. The baton according to claim 4, wherein said retaining means includes two end caps, mounted one on each of said opposite ends of said tube, each said end cap having an outer cross-sectional diameter greater than the inner diameter of said band thereby retaining said band on said tube.

7. The baton according to claim 6, wherein each said end cap includes an outer surface and a projection on the outer surface of each said end cap aligned in a pre-determined position relative to said center of gravity thereby alerting the user of the longitudinal resting position of the baton.

8. A baton comprising:

a rigid elongate cylindrical tube formed of plastic and having a longitudinal axis, two opposite ends, and a uniformly shaped and sized cross-section along said longitudinal axis;

a metal rod positioned in said tube and displaced off-center relative to said longitudinal axis thereby reducing the tendency of said tube to roll when laid upon a substantially horizontal supporting surface;

a foam substance received within said tube and securing and retaining said rod in said off-center position;

a substantially rigid circular band encircling said tube and capable of sliding along the length of said tube, said band having an inner diameter greater than the outer diameter of said cross-section forming a gap of predetermined amount between said band and said tube;

a pair of end caps, mounted one on each of said opposite ends of said tube, each said end cap having an outer cross-sectional diameter greater than the inner diameter of said band thereby retaining said band on said tube, each said end cap having a flat surface generally perpendicular to said longitudinal axis permitting said tube to rest vertically on a generally horizontal surface; and a length of flexible material having two opposite end portions, said material doubled upon itself defining a loop extending through said gap, said end portions having a substantially inelastic thickness greater than said gap to prevent said loop from being withdrawn from said band.

9. The baton according to claim 6 wherein each said end cap includes a flat surface generally perpendicular to said longitudinal axis permitting said tube to rest vertically on a generally horizontal surface.

10. The baton according to claim 1 further including an end cap mounted at one of said opposite ends of said shaft and having a flat surface generally perpendicular to said longitudinal axis permitting said shaft to rest vertically on a generally horizontal surface.

11. The baton of claim 1 wherein said retaining means includes two end caps, mounted one on each of said opposite ends of said shaft, each said end cap having an outer cross-sectional diameter greater than the inner diameter of said shaft thereby retaining said band on said shaft.

* * * * *